United States Patent [19]

Birke et al.

[11] 3,993,434

[45] Nov. 23, 1976

[54] PROCESS AND DEVICE FOR THE FIXATION OF PRINTS WITH REACTIVE DYESTUFFS

[75] Inventors: Walter Birke, Frankfurt am Main; Erich Feess, Lorsbach, Taunus; Hans-Ulrich von der Eltz, Frankfurt am Main; Kurt Roth, Hofheim, Taunus; Franz Schön, Frankfurt am Main, all of Germany

[73] Assignee: Hoechst Aktiengesellschaft, Frankfurt am Main, Germany

[22] Filed: Oct. 11, 1973

[21] Appl. No.: 405,425

[30] Foreign Application Priority Data

Oct. 14, 1972 Germany ..... 2250504

[52] U.S. Cl. ..... 8/1 A; 8/74

[51] Int. Cl.[2] ..... D06P 5/00

[58] Field of Search ..... 8/74, 1 A

[56] References Cited

UNITED STATES PATENTS 3,909,196 9/1975 Birke et al. ..... 8/140

*Primary Examiner*—M. J. Welsh

*Attorney, Agent, or Firm*—Curtis, Morris & Safford

[57] ABSTRACT

Process for the fixation of prints with reactive dyestuffs, wherein an aqueous alkaline bath which contains an inflammable organic liquid is applied onto the printed and dried material, the said organic liquid is burned off after passage of the material through air and the said material is further treated in the usual manner. This process has the advantage, in addition to the usual advantages of a continuous method of operation over a discontinuous method, that special steamers for the fixation are not necessary. The burning off process is effected in an essentially simpler apparatus, in the most simple case a burning-off duct is sufficient. Moreover, the new process requires less energy than the conventional fixing processes.

9 Claims, 1 Drawing Figure

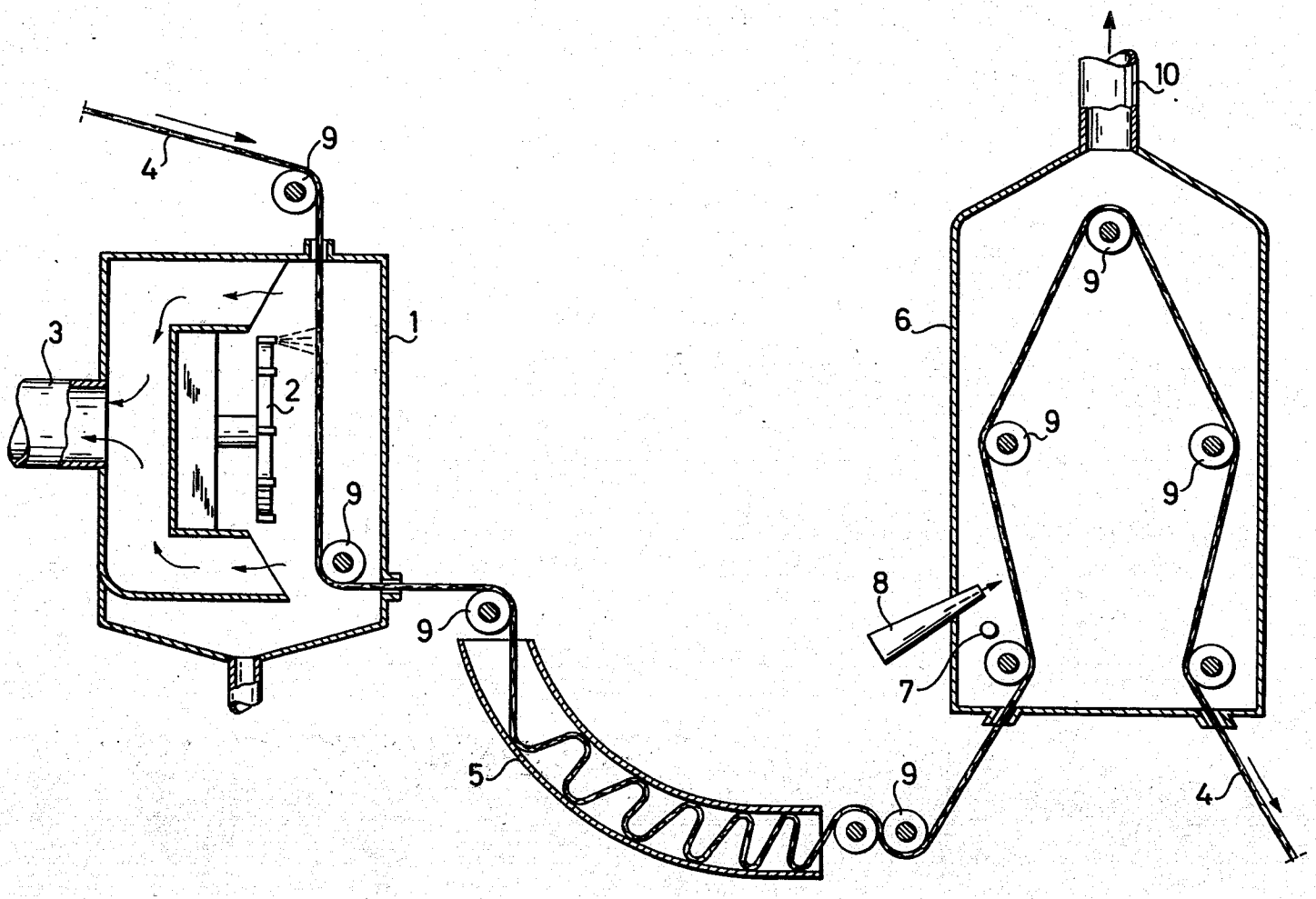
1
2
3
4
5
6
7
8
9
10

PROCESS AND DEVICE FOR THE FIXATION OF PRINTS WITH REACTIVE DYESTUFFS

The fixation of reactive dyestuffs was effected hitherto either discontinuously according to the cold dwell process or continuously according to the two-phase process in which fixation took place by steaming with saturated steam or solvent vapors or by wet fixation with a hot alkaline electrolyte bath.

Now, we have found that prints with reactive dyestuffs on cellulose fibers alone or in admixture with polyester fibers can be fixed by applying onto the printed and dried material an aqueous alkaline bath which contains an inflammable organic liquid, burning this liquid after a passage through air and further treating the material in the usual manner.

The aqueous bath contains alkali, for example sodium hydroxide, in a quantity which is sufficient for fixing the dyestuff on the fiber.

The inflammable organic liquids which may be used in the process of the invention comprise all inflammable water-soluble or water-miscible and, when combined with emulsifiers, waterinsoluble liquids; however, for security reasons, such liquids which have very low ignition points or develop too strong a heat during burning off and have too low evaporation points are not suitable. Particularly suitable are lower aliphatic alcohols, preferably those containing 1 to 3 carbon atoms, especially methanol. The said solvents are used alone or in admixture with water. However, it is also possible to add small amounts of such organic solvents which develop strong heat during burning off, especially when working with mixtures which contain high amounts of water. Particularly suitable are those mixtures which contain between 10 and 50% by volume of methanol and 90 and 50% by volume of water, preferably 10 to 20% by volume of methanol. The addition of water permits also to control the speed of the burning off process. In this manner, an optimal mixture can be found for every fiber material which prevents ignition of the fiber material during burning off.

The process of the invention is carried out by spraying, nip-padding or padding the printed and dried material in the usual manner with a bath which contains different amounts of one or several inflammable liquids. The bath may additionally contain other chemical agents and auxiliary agents such as after-treating agents, wetting agents, fiber swelling agents or fixation accelerators. The quantity of burnable organic liquid added may vary within wide limits and depends on the textile material to be treated and on the type of the dyestuff.

After spraying, nip-padding or padding, the material is allowed to dwell for some time in the air. This is effected, for example, on a J-shaped slide (boot), on a conveyor belt or by docking. During this air passage, the dyestuff is already prefixed. The duration of this air passage depends on the type of reactive dyestuff used and on the desired degree of pre-fixation. In general, the air passage takes 5 seconds to 5 minutes. The air passage may also be omitted, but it is then necessary to allow the material to dwell for 2 to 20 hours after burning. This method is especially advantageous with thin fabrics, because no staining occurs in this case.

After this air passage the inflammable organic solvent is ignited by a suitable ignition device and burnt off completely. For safety reasons it is advisable to use such mixtures of water and inflammable organic solvents the flash point of which is above the room temperature. With such mixtures it is necessary to install an ignition device which supplies the energy necessary for heating up the solvent vapors over the flash point. During this burning off process that part of the dyestuff is fixed which has not been fixed during passage through the air. The material is then further treated in the usual manner by rinsing, washing and drying.

The process of the invention may be used for textile materials of any kind, for example fabrics, knit goods or fiber fleeces.

The reactive dyestuffs used in the process of the invention may be those which contain β-oxethyl-sulfone-sulfuric acid ester or - phosphoric acid ester groups, N-methyl-N-β-sulfatoethylsulfonamino groups, β-sulfatoethyl-aminosulfone groups, chloropropionylamido groups, β-sulfatoethyl-carbonamido groups, phenylproprionyl-amidosulfone groups or 2,2,3,3-tetrafluorocyclobutane-1-acryloylamino groups. With certain precautionary measures which reduce the sensitivity to acid hydrolysis, for example by the addition of sodium acetate to the printing paste, there may also be used a number of reactive dyestuffs which react ester-like with the cellulose, for example those dyestuffs which contain a mono- or dichloro-triazine group, the trichloro-pyrimidine group, the dichloro-quinoxaline group the dichloro-phthalazine group or the dichloro-pyridazine group. If mixture fabrics of cellulose and polyester fibers are printed, the printing pastes additionally contain disperse dyestuffs which are necessary for the dyeing of the polyester portion.

The process of the invention has the advantage, in addition to the usual advantages of a continuous method of operation over a discontinuous method, that special steamers for the fixation are not necessary. The burning off process is effected in an essentially simpler apparatus, in the most simple case a burning-off duct is sufficient. Moreover, the new process requires and consumes considerably less energy than the conventional fixing processes.

An apparatus which is suitable for carrying out the process of the invention is illustrated by the Figure in the annexed drawing. It consists essentially of a spray chamber 1 with a spraying device 2, a slide 5 and a burning-off chamber 6. The spraying device which is shown in the drawing in a side view is arranged in front of the fabric web 4. It consists of two driving pulleys over which an endless belt is running that is provided with a number of spray nozzles. With this spraying device the aqueous-alkaline bath which contains an inflammable liquid is sprayed onto the material to be treated. After having left the spraying chamber, the material is passed through a slide 5 where it is dwelling for some time and is run over guide rollers 9 through the burning-off chamber 6. The ignition device 7 is arranged at the entrance place of the material and likewise are there positioned elements supplying combustion air 8. The head of the burning-off chamber has an opening 10 through which the hot exhaust gases can escape. Spraying chamber 1 is provided with a suction device 3.

The following Examples illustrate the invention:

EXAMPLE 1

60 g of C.I. Reactive Orange 7 were dissolved in 410 g of hot water and then stirred into 520 g of a 4% aqueous alginate thickener paste. The cooled printing paste was subsequently combined with 10 g of the sodium salt of 3-nitro-benzenesulfonic acid. A cotton fabric was printed with this printing paste and dried. Then a liquor consisting of 500 ml of methanol, 150 ml of sodium hydroxide solution (38° Be) and 350 ml of water was sprayed onto the fabric with a liquor absorption of 50%. The fabric so treated was then allowed to dwell for 5 minutes on a slide and subsequently passed into a burning-off chamber where the methanol-containing liquor was burned off. The fabric was then rinsed, washed and dried.

EXAMPLE 2

A causterized cotton fabric was printed with the printing paste having the composition given in Example 1, but containing 60 g of C.I. Reactive Blue 27 as the dyestuff. The printed fabric was dried and padded, with a liquor absorption of 70%, with a liquor which consisted of 300 ml of methanol, 100 ml of potassium hydroxide solution (38° Be) and 600 ml of water. The fabric was then passed over a transportation band in such a manner that the dwelling time was 5 seconds. Subsequently, the methanol-containing liquor was burned off and the fabric was further treated in the usual manner.

EXAMPLE 3

40 g of C.I. Reactive Red 29 were dissolved in 430 g of hot water and subsequently stirred into 520 g of a 4% aqueous alginate thickener paste. To this printing paste, 10 g of the sodium salt of 3-nitro-benzene-sulfonic acid were added. A mercerized cotton fabric was printed with this printing paste and then dried. A liquor consisting of 50 ml of methanol, 50 ml of potassium hydroxide solution (38° Be), 50 ml of sodium hydroxide solution (38° Be) and 850 ml of water was then sprayed onto the fabric with a liquor absorption of 60%. The fabric was then passed directly into a burning-off chamber where the methanol-containing liquor was burned off. The dried fabric was allowed to stay overnight and further treated in the usual manner.

EXAMPLE 4

80 g of C.I. Reactive Black were dissolved in 390 g of hot water. The preparation of the printing paste was carried out in the manner indicated in Example 3 with the addition of an alginate thickening and the sodium salt of 3-nitro-benzenesulfonic acid. A cotton fabric was printed with this printing paste. After drying, a liquor consisting of 400 g of methanol, 100 g of sodium hydroxide solution (38° Be) and 500 g of water was sprayed onto the fabric with a liquor absorption of 30%. After an air passage of 5 seconds, the methanol-containing liquor was burned off and the fabric was further treated in the usual manner.

EXAMPLE 5

A causterized cotton fabric was printed with a printing paste having the composition given in Example 1, but which contained 60 g of C.I. Reactive Yellow 23 as the dyestuff. An aqueous liquor which consisted of 100 g of methanol, 200 g of potassium hydroxide solution (38° Be) and 700 g of water was then sprayed onto the printed and dried fabric. After an air passage of 2 seconds, the methanol-containing liquor was burned off and further treated in the usual manner.

EXAMPLE 6

A mixture of 24 g of the disperse dyestuff of the formula

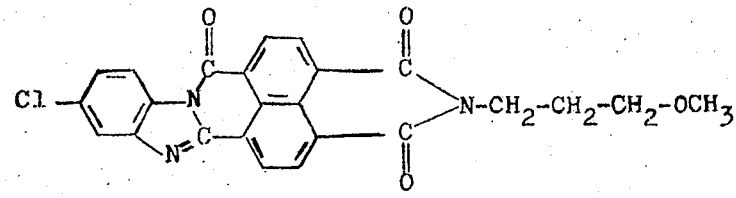

and 16 g of the reactive dyestuff of the formula

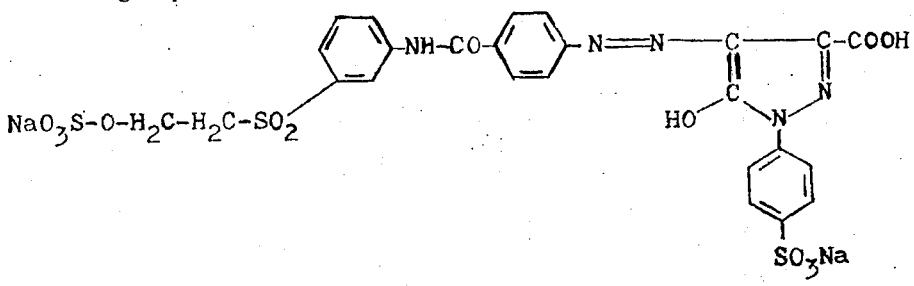

were dissolved or dispersed in water having 80° – 90° C, introduced into 350 g of a 10% alginate thickening and combined with 50 g of a 10% solution of the addition compound of polyglycol 2000 and stearic acid. Then, 100 g of heavy gasoline were introduced by emulsification and 2 g of monosodium phosphate and 10 g of the sodium salt of m-nitrobenzene-sulfonic acid were added.

Bleached, mercerized knit goods of polyester/cotton 67:33 were printed with this printing paste, dried and thermofixed for 60 seconds at 190° C. The goods were then sprayed, with a liquor absorption of 30%, with a liquor which consisted of 200 g of methanol, 580 g of water, 200 g of sodium hydroxide solution (38° Be), 20 g of a mixture of 20 parts of the addition product of 30 mols of ethylene oxide and 1 mol of diphenylolpropane, 20 parts of the addition product of 6,5 mols of ethylene oxide and 1 mol of stearyl alcohol and 60 parts of polyglycol (MV 400). The goods were then placed on a transportation band in such a manner that the air passage was 5 seconds and subsequently introduced into a burning off chamber where the methanol-containing liquor was burned off. The goods were further treated in the usual manner by rinsing, washing and drying.

EXAMPLE 7

80 g of the dyestuff mixture of 55 parts by weight of 1,4-diamino-2,3-diphenoxy-anthraquinone and 45 parts by weight of the dyestuff formed by coupling the diazotized 1-aminobenzene-4-β-oxethylsulfonesulfuric acid ester with 8-acetylamino-1-naphthol-3,6-disulfonic acid and conversion into the copper complex, were dissolved or dispersed in 420 g of water having 80° – 90° C and stirred into 500 g of the following master thickening:

Master thickening 400 g of aqueous 10% alginate thickening 260 g of aqueous 10% locust bean flour ether thickening 4 g of monosodium phosphate 126 g of cold water 50 g of an aqueous 10% solution of the addition product of polyglycol 2000 and stearic acid 10 g of the sodium salt of m-nitrobenzene-sulfonic acid 150 g of heavy gasoline.

A bleached mercerized mixed fabric of polyester/cotton 65/35 was printed with this printing paste and dried.

The fabric was thermofixed for 45 seconds at 200° C and then sprayed with a liquor which consisted of 100 g of methanol, 80 g of sodium hydroxide solution (38° Be) and 820 g of water. This liquor was burned off in a suitable burning chamber and the fabric was subsequently allowed to dwell in the cold for 6 hours. The fabric was then further treated in the usual manner by rinsing, washing and drying.

We claim:

1. A process for fixing a reactive dyestuff printed on textile material containing cellulose fibers, which comprises applying to printed and dried textile material an aqueous alkaline bath containing an inflammable organic liquid, passing the textile material through an air atmosphere, igniting and burning the organic liquid from the textile material, thereby heating and fixing the dyestuff.

2. The process of claim 1 wherein the textile material contains cellulose fibers and polyester fibers.

3. The process of claim 1 wherein the textile material is passed through an air atmosphere for about 5 seconds to 5 minutes.

4. The process of claim 1 wherein the inflammable organic liquid comprises a lower aliphatic alcohol having 1 to 3 carbon atoms.

5. The process of claim 4 wherein the organic liquid comprises 10 to 50% by volume of methanol and 90 to 50% by volume of water.

6. A process for fixing a reactive dyestuff printed on textile material containing cellulose fibers, which comprises applying to printed and dried textile material an aqueous alkaline bath containing an inflammable organic liquid, igniting and burning the organic liquid from the textile material to heat the textile material, and allowing the textile material to dwell for a period of 2 to 20 hours thereby fixing the dyestuff.

7. The process of claim 6 wherein the inflammable organic liquid comprises a lower aliphatic alcohol having 1 to 3 carbon atoms.

8. The process of claim 6 wherein the organic liquid comprises 10 to 50% by volume of methanol and 90 to 50% by volume of water.

9. The process of claim 6 wherein the textile material contains cellulose fibers and polyester fibers.

* * * * *